US009468895B2

(12) United States Patent
Hart et al.

(10) Patent No.: US 9,468,895 B2
(45) Date of Patent: Oct. 18, 2016

(54) ADVANCED LABORATORY PLATFORM ROCKER

(71) Applicants: Brendan Hart, Troy, NY (US); David Grinnell, Averill Park, NY (US); Ian Glasgow, Averill Park, NY (US)

(72) Inventors: Brendan Hart, Troy, NY (US); David Grinnell, Averill Park, NY (US); Ian Glasgow, Averill Park, NY (US)

(73) Assignee: Forward Biotech, Inc., Averill Park, NY (US)

( * ) Notice: Subject to any disclaimer, the term of this patent is extended or adjusted under 35 U.S.C. 154(b) by 78 days.

(21) Appl. No.: 14/243,366

(22) Filed: Apr. 2, 2014

(65) Prior Publication Data

US 2014/0293733 A1 Oct. 2, 2014

Related U.S. Application Data

(60) Provisional application No. 61/808,256, filed on Apr. 4, 2013, provisional application No. 61/807,413, filed on Apr. 2, 2013.

(51) Int. Cl.
*B01F 11/00* (2006.01)
*B01F 15/02* (2006.01)

(52) U.S. Cl.
CPC ..... *B01F 15/0295* (2013.01); *B01F 11/0017* (2013.01); *B01F 15/0212* (2013.01)

(58) Field of Classification Search
CPC ..... G01N 35/1079; G01N 2035/00564; B01L 2300/0672; B01L 3/502; B01J 2219/00351; B01J 2219/0036; B01F 15/0295
USPC ..... 366/185; 422/105
See application file for complete search history.

(56) References Cited

U.S. PATENT DOCUMENTS

| | | | | |
|---|---|---|---|---|
| 1,184,848 | A | 5/1916 | Geiger | |
| 5,567,595 | A * | 10/1996 | Kok | G01N 33/54366 422/536 |
| 5,674,006 | A * | 10/1997 | Islam | G01N 1/312 206/219 |
| 5,705,384 | A * | 1/1998 | Berndt | C12M 27/10 356/427 |
| 6,398,956 | B1 * | 6/2002 | Coville | B01D 61/147 210/321.75 |
| 2004/0126279 | A1 * | 7/2004 | Renzi | B01L 3/502715 422/502 |
| 2004/0209346 | A1 | 10/2004 | Adelberg | |
| 2010/0262303 | A1 * | 10/2010 | Yu | G01N 35/08 700/282 |
| 2013/0143209 | A1 * | 6/2013 | Strong | G01N 21/07 435/6.11 |
| 2013/0203072 | A1 | 8/2013 | Tian et al. | |
| 2014/0293733 | A1 | 10/2014 | Hart | |

* cited by examiner

*Primary Examiner* — Tony G Soohoo
*Assistant Examiner* — Elizabeth Insler

(57) ABSTRACT

This document describes an advanced laboratory platform rocker. An electronic circuit controls the rotation of the shaft of a motor. The shaft is coupled to the platform, such that the angular position of the platform is controllable, as a function of time, enabling non-periodic and non-steady motion. The rotation of the platform can be used to perform other functions, such as initiating the dispensing of liquid into a tray on the platform, and dispersing of liquid from a tray on the platform.

4 Claims, 11 Drawing Sheets

ADVANCED LABORATORY PLATFORM ROCKER

FIELD OF THE INVENTION

This invention applies to platform rockers, commonly used in laboratories to move liquids for mixing and for interactions with a substrate.

BACKGROUND OF THE INVENTION

Platform rockers are very commonly used in biology laboratories. Typically, a platform tilts back and forth, in a fashion similar to a see-saw or teeter-totter. The user may place containers of liquids and/or other items, on the platform. This see-saw action keeps the contents of the containers mixed. The rocking see saw action is used for many applications, such as culturing cells, staining gels, and hybridization of nucleic acids. In most platform rockers, the motor runs at a selectable, constant speed, typically in the realm of 10 to 60 rocking cycles per minute. A motor turns a cam or 4-bar linkage, connected to the platform. As the cam rotates at a constant speed, it drives a linkage causing the platform to tilt back and forth. While this is good for some applications, there are many other applications that require an advanced platform rocker able to adjust the rocking parameters as a function of time or in response to signals from sensors or other devices. In addition, an advanced platform rocker that can vary the range of tilt can use the action of tilting the platform to perform other functions.

One very common application of platform rockers entails the staining of blots and gels. Blots and gels are widely used in molecular biology to separate and distinguish nucleic acids and proteins. In Western Blots, also called protein immunoblots, there is a series of reagents and wash buffers that interact with the blots. Similar, although shorter, protocols are used with other immunoassays for nucleic acids. Typically the first step entails electrophoresis to cause the nucleic acids or proteins to travel through a gel at different rates depending upon size and charge. Bands in a gel can be transferred to a blot. The bands can be imaged using reagents that bind to the bands and then washing steps remove the reagents which are not attached to the bands. The images reveal the size and charge of the nucleic acids or proteins. The nucleic acids or proteins of interest can be selectively removed for further analysis. The binding and washing steps typically require manual labor to add and remove the reagents and wash buffers. While several automated instruments exist, they have shortcomings. For example they require complex plumbing with multiple pumps and/or valves, and relatively large volumes of reagents. This patent covers innovative features for an advanced rocker capable of manipulating volumes of liquids, thereby foregoing these limitations.

Typically, the steps involving incubation with reagents and washing is performed in a flat bottomed tray. To reduce the volume of reagent required to react with the blot, the blot can be placed in a bottle on a bottle roller, whereby a minimal volume of liquid washes over the blot or gel as the bottle rotates. Gravity and the shape of the bottle ensure that the liquid covers the entire blot laterally. In a flat bottomed tray, to ensure complete coverage laterally across the blot or gel, a much larger volume of liquid is required. An advanced rocker, cable of holding trays with convex bottoms, simulating the cylindrical shape of a bottle, and pivoting near the axis of curvature of the bottom surface of the trays, enables the use of smaller volumes of reagents. Ideally, the incubation with antibodies is performed at a slow rocking speed, while the washing steps are more vigorous. With an advanced platform rocker, the dispensing of liquids into the trays and removal of the liquids from the trays can be accomplished without valves, pumps or tubing.

This invention can also be used for other procedures that entail reactions with reagents and/or washing of samples, such as fluorescence in situ hybridization (FISH), a technique that requires many steps involving reagents and washing.

There are other applications in which a platform rocker that performs a series of cycles, in which each cycle comprises a series of steps, would enable better results. For simplicity, we will call these advanced rocking routines. For example, in hybridization of nucleic acids, depletion zones form in the liquid as free molecules bind to those attached to the substrate. A symmetric routine is not efficient at mixing the liquid in this low Reynolds number situation. An asymmetric routine, however, in which the platform pauses at a steeper angle in one direction, and then at a less steep angle in the other, enables better microfluidic mixing, and thus, better hybridization results. The advanced platform rocker described here can also rock at extremely low rocking speeds for specialized applications, such as just several rock cycles per hour, or rock once or twice, then wait a day before repeating this cycle. This is advantageous for containers that are in storage with contents that would otherwise settle. Such an advanced platform rocker is also beneficial for viral transduction. In this process, scientists desire a periodic routine that allows diffusion to occur while their sample is stationary, allowing the molecules to interact with the substrate, for perhaps fifteen minutes, and then recharges the depletion region by rocking their sample, thereby mixing their solution. Currently, the rocking is started and stopped manually. In some washing and mixing applications, a high frequency but low amplitude agitation superimposed upon a low frequency, high amplitude agitation would provide better washing or mixing. Likewise, some microfluidic applications require gravity to force a small amount or portion of liquid from one section of the microfluidic device to another according to a particular schedule.

SUMMARY OF THE INVENTION

This invention entails a sophisticated platform rocker, whereby the angular position of the platform can be accurately controlled as a function of time. This enables specialized mixing and manipulation of liquids and enables the platform rocker to perform additional functions, such as pouring of liquids and triggering the dispensing of liquids, thereby simplifying the automation of some processes.

Figure 1:
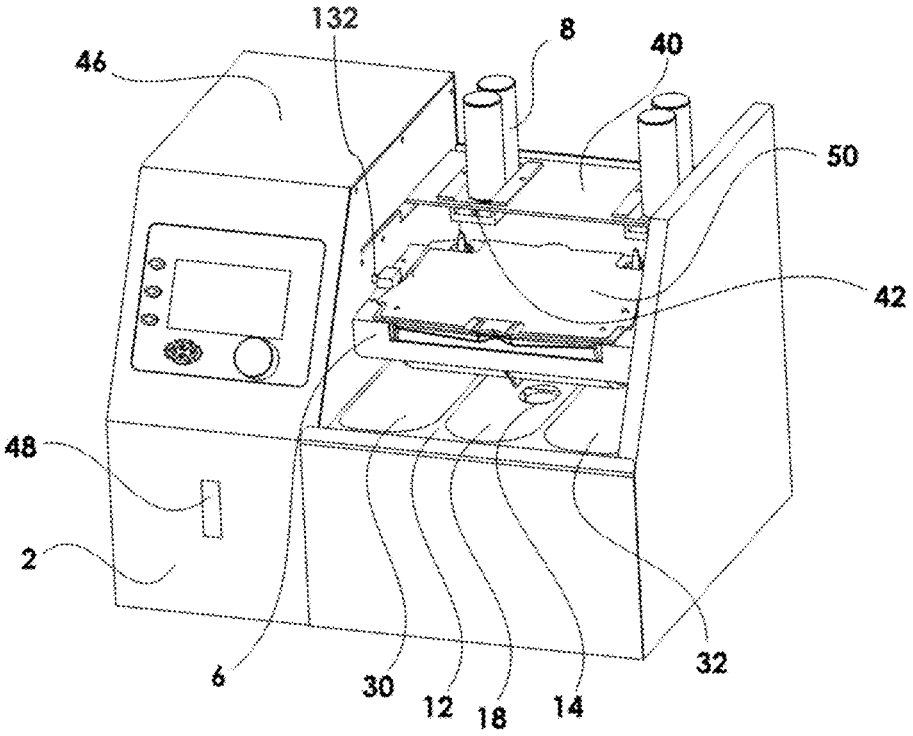
FIG. 1 shows a diametric view of the present invention according to one embodiment.

DESCRIPTION OF THE DRAWINGS:

FIG. 1. This figure shows a specialized advanced platform rocker (2) designed for staining immunoblots, with feature for liquid handling. There are one or more trays (4) that are on a cutout platform designed as a tray holder (6) for clamping the convex bottom trays (4) in the cutouts. The tray holder platform (6) pivots, thus creating a rocking motion. The motor is not visible in this view. The shaft of the motor (132) can be seen where it attaches to the tray holder (6). Reagent tubes (8) which contain the liquid reagents, serve as reservoirs. Trays (4) have a cover (50) and pour spouts (16) that direct liquids to drain into a catch tray (12) with a central funnel-like region (18) with drain (14) and additional funnel-like regions (30, 32) with their own drains. As the trays (4) pivot to large angles, the liquid in them will drain into the catch tray (12). The trays (4) are removable for cleaning. The slider (40) is a support structure that holds the reagent tubes (8) in FIG. 3. The slider (40) is positioned by a motor (52) (shown in FIG. 5) that runs on a lead screw (53), to enable different reagent tubes (8) or fitting (42) to be properly located over the trays (4) for dispensing of liquids. The fitting (42) would be connected by tubing to a pump and a reservoir of a buffer or reagent. A wider slider would have room for more reagent tubes (8) or fittings (42), thus enabling more reagents or buffers to be dispensed.

A camera could be mounted to the top surface of the instrument (46) or on the slider (40) to image the blots or samples in the trays (4), and enable the electronic circuit to determine when to proceed to the next step in the routine.

Slot (48) is for memory devices or connectors of cables for transferring instructions, programs, or history to or from the instrument.

Notice that the platform rocker (2) can be wider with room for additional trays (4).

Figure 2:
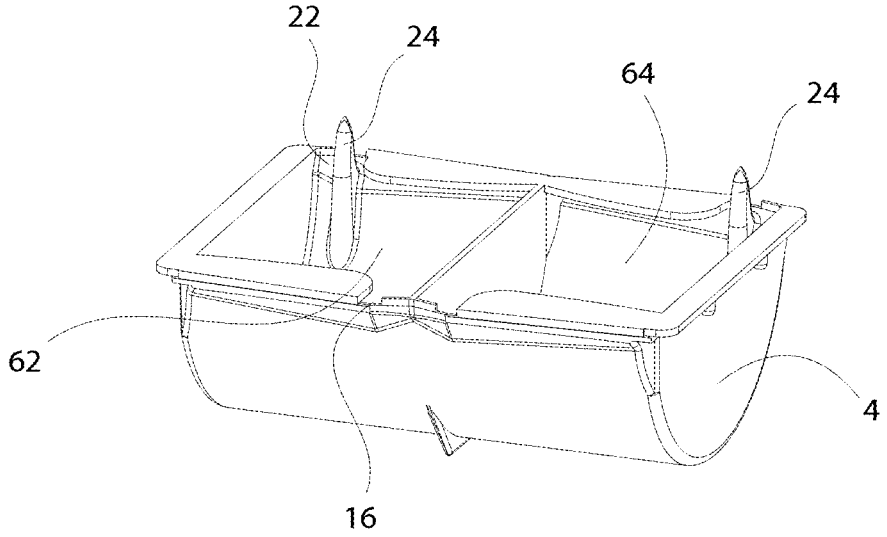
FIG. 2 shows a diametric view of the convex bottom tray and its features.

FIG. 2. Spouts (16) and (22) on opposite sides and not in the same lateral line or rotational path of the trays (4) enable the liquid to drain into different funnel-like regions (18) of the catch tray (12) of FIG. 1, depending upon which way the trays (4) are pivoted. The trays (4) contain lances (24), which provide a means for piercing the seal(10) in FIG. 3. The trays (4) have a convex bottom to enable smaller volumes of reagents to be used. Trays with flat bottoms, which are typical of use with platform rockers, or other shapes could also be used. The tray (4) in this figure has 2 compartments (62, 64). However, the tray could have only one compartment, or a plurality of compartments. The trays (4) are removable from the instrument (2). In the embodiment shown, the trays (4) are removable from the cutouts in the tray holder platform (6), so trays can be removed for convenience, cleaning, or replacement with trays of different geometry or material. In other embodiments, the trays (4) could be mounted without a tray holder platform (6) with cutouts, perhaps by including additional mounting features on the trays (4)so that they behave as flat bottomed trays.

Figure 3:
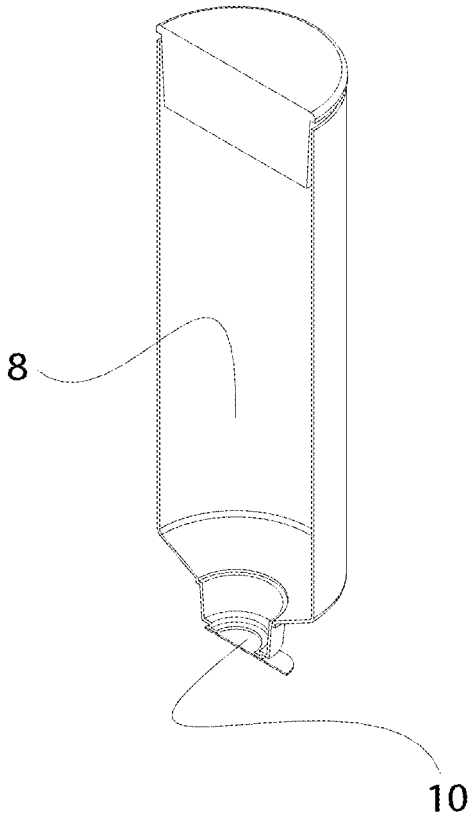
FIG. 3 shows a cutaway view of a reagent tube.

FIG. 3 shows a reagent tube (8) serving as a liquid reservoir. There is a seal at the bottom (10) of each reagent tube (8). The seal (10) could be a foil or other membrane.

Figure 4:
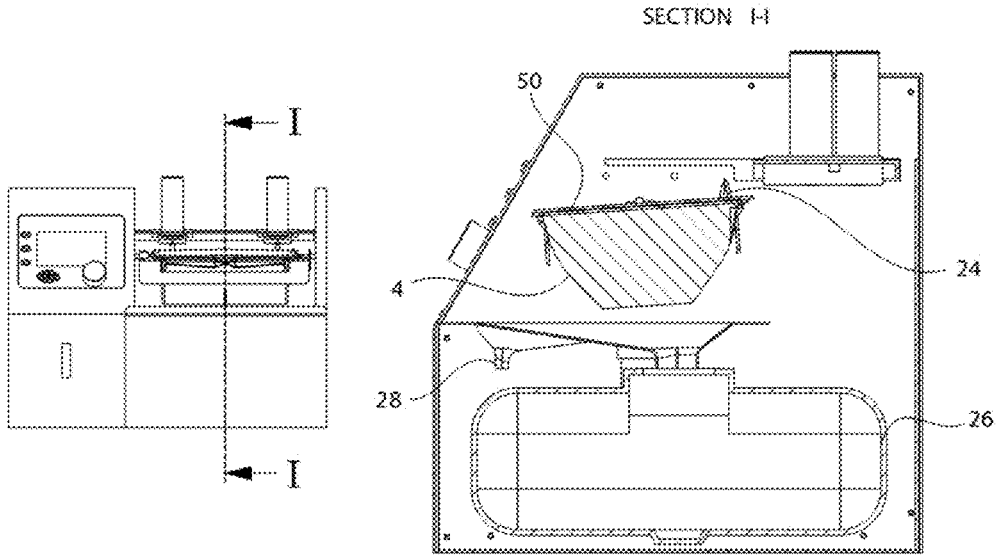
FIG. 4 shows a cross-section view of the rocker according to one embodiment.

FIG. 4. The lances (24) of the trays (4), puncture the seals (10) when the reagents from the reagent tubes (8) are to be dispensed into the trays (4). The lances (24) could be located on covers (50) of the trays, instead of the trays (4) themselves. Alternatively, the lances (24) could be located on a separate mechanism.

Figure 5:
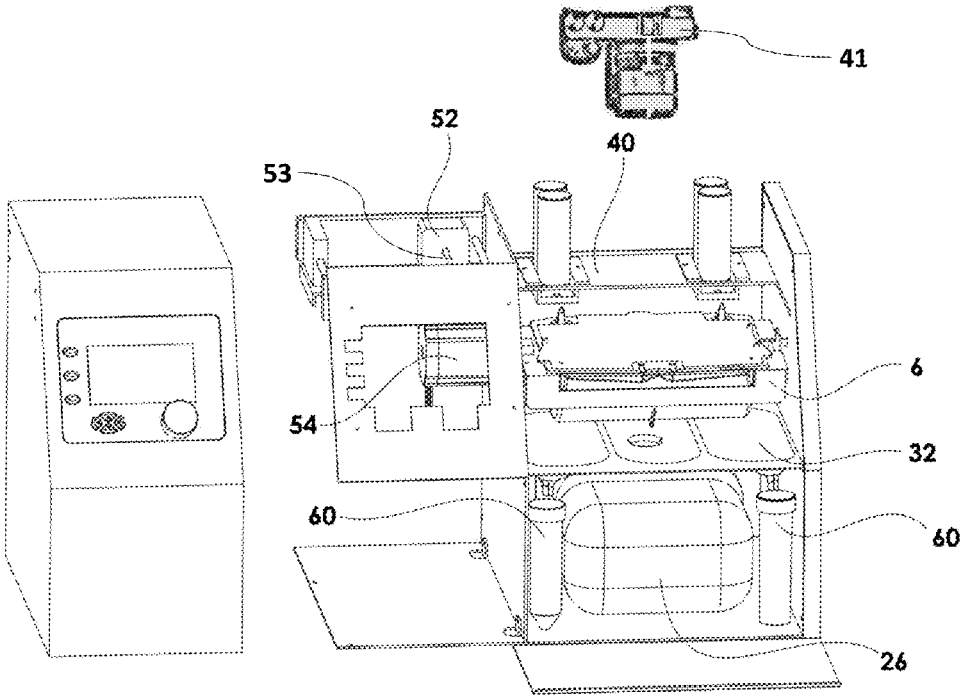
FIG. 5 shows a partially open view of the rocker according to one embodiment.

The catch tank (26) can be emptied by removing it from the instrument (2), or possibly with an additional pump. The funnel-like region (30) of FIG. 1 has drain (28) that empties into a recovery container (60) in which the liquid can be recovered. 5a FIG. 5 shows the platform rocker (2) with some of the housing The slider motor (52), which runs along a lead screw (53), drives the slider (40), thereby providing a means to position the slider. The rock motor (54) drives the rocking of the platform (6) and tray (4). Both of these motors could be replaced with actuators or comparable driving methods. Note that liquid draining into the right most funnel-like region (32) of catch tray (12) will drain into recovery container (60). A CCD camera (41) images the blots, and communicates with the electronic circuit using Bluetooth.

There could be multiple recovery containers (60). The slider motor (52) or actuators or other motor could move the recovery containers (60) or be a means to translate the catch tray (12) so that multiple liquids can be recovered in separate containers or the catch tank (26).

As liquid from tray (4) drains through spout (22), it lands in funnel-like region (30) of catch tray (12), and then into a recovery container (60). If the tray (4) is tilted to a large angle in the opposite direction, the liquid will drain through spout (16) into funnel-like region (18), through the drain (14), and into the catch tank (26).

Figure 6:
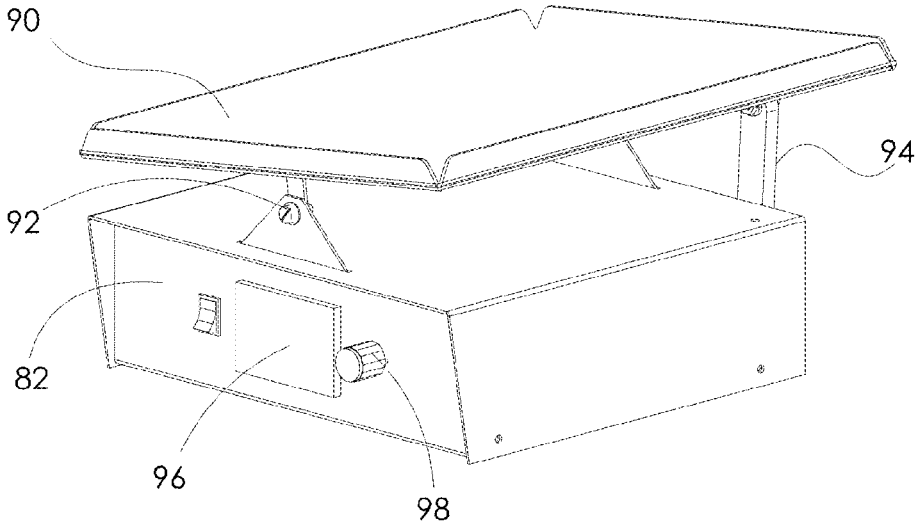
FIG. 6 shows a diametric view of the present invention of another embodiment.

FIG. 6 shows a different embodiment of a general purpose advanced platform rocker designed for use with flat bottomed trays. There is a chassis (82), a platform (90) to support flat bottomed trays and other items, pivots (92) and a linkage (94). Also shown are a display (96) and a control knob (98), to enable a user to operate the platform rocker.

Figure 7:
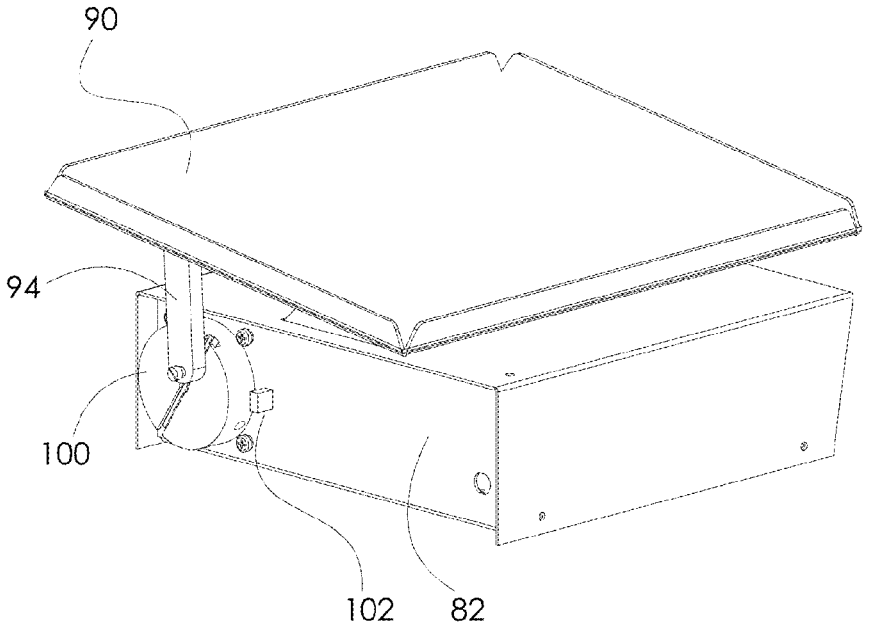
FIG. 7 shows a diametric view of the back of the present invention of another embodiment.

FIG. 7, is a rear view of the platform rocker, showing the means for controllably coupling the motor to the platform. The linkage (94) connects a cam (100) with the platform (90). As the cam (100) turns, the platform (90) rocks about the pivots (92). A sensor (102) monitors the position of the cam (100).

Figure 8:
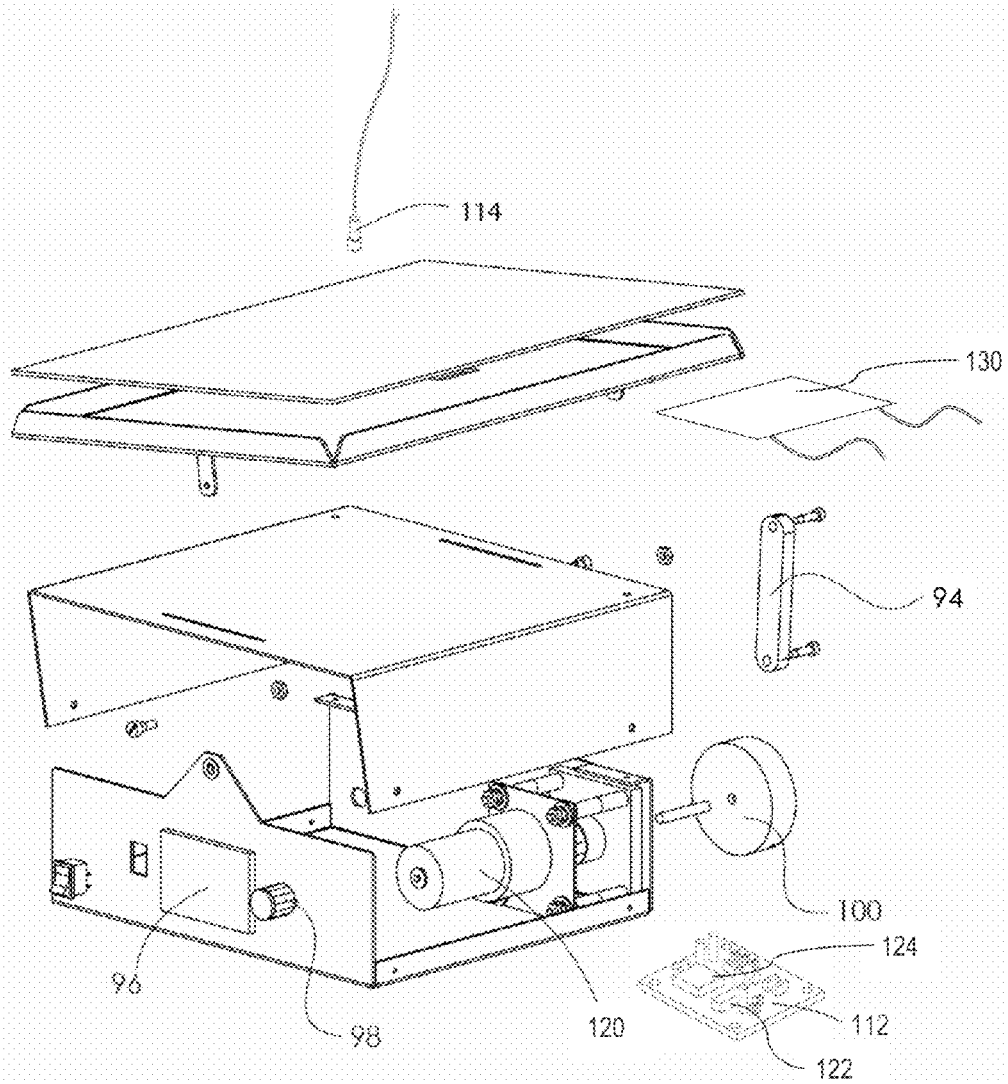
FIG. 8 shows an exploded view of the present invention of another embodiment.

FIG. 8 shows the internal components of a platform rocker, including the motor (120) which moves the platform with linkage (84), and the electronic circuit (112) with an external sensor (114) connected to the electronic circuit (112). Likewise, the electronic circuit (112) could also receive signals from a separate instrument via a Bluetooth or other connection. The electronic circuit (112) includes a microcontroller (122) and a field programmable gate array (FPGA) (124). A heating pad (130) can be mounted to the platform to exchange heat with the tray.

Figure 9:
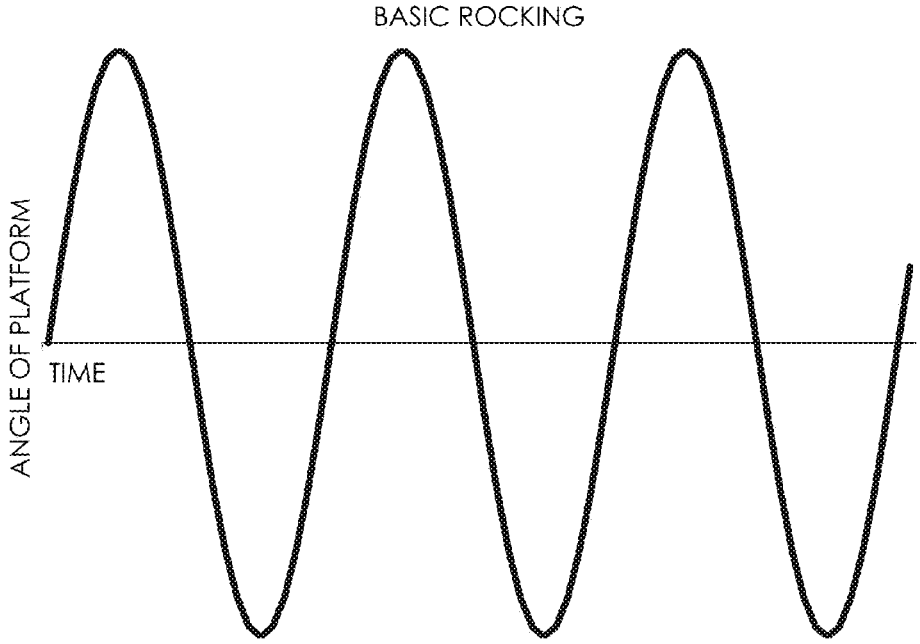
FIG. 9 shows a graph of platform angle over time during basic rocking.

FIG. 9 is a graph showing the typical angle of the platform with respect to time for a basic platform rocker.

Figure 10:
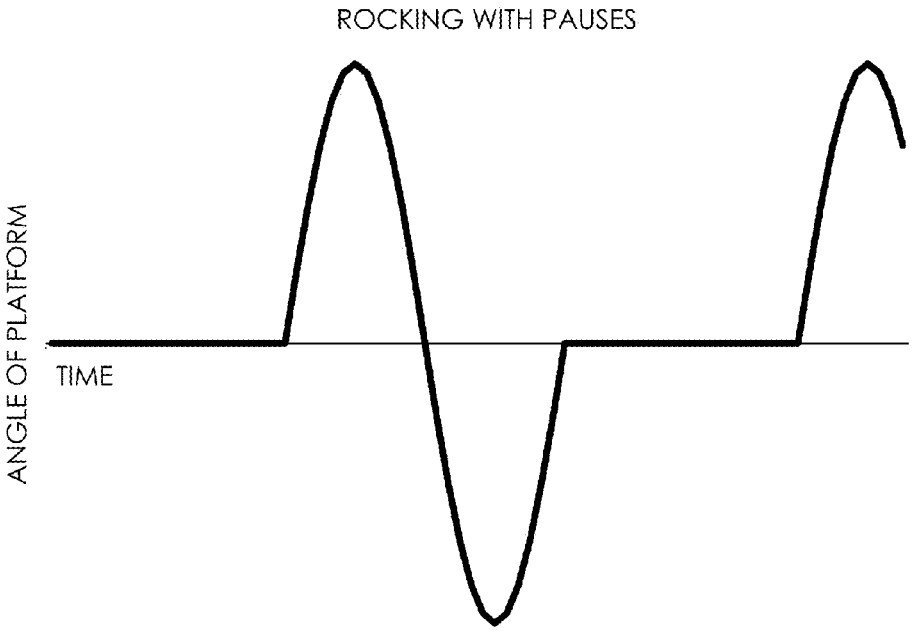
FIG. 10 shows a graph of platform angle over time including pauses between each rock.

FIG. 10 is a graph showing a platform rocker routine with pauses between periods of rocking.

Figure 11:
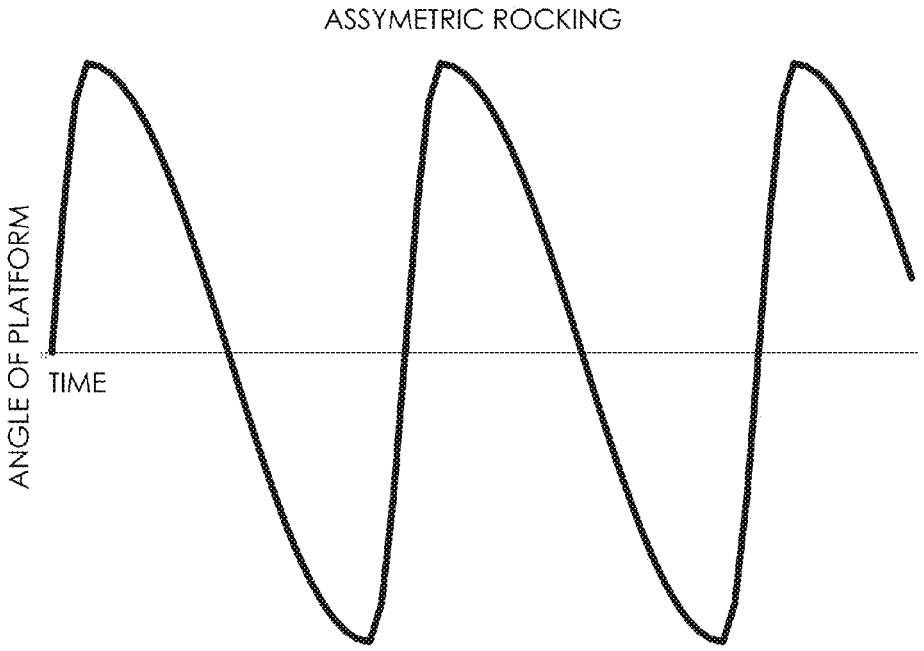
FIG. 11 shows a graph of platform angle over time with variable rocking speed.

FIG. 11 is a graph showing a platform rocker routine in which the rocking is faster for the first half of each rocking cycle, and slower for the second half.

Figure 12:
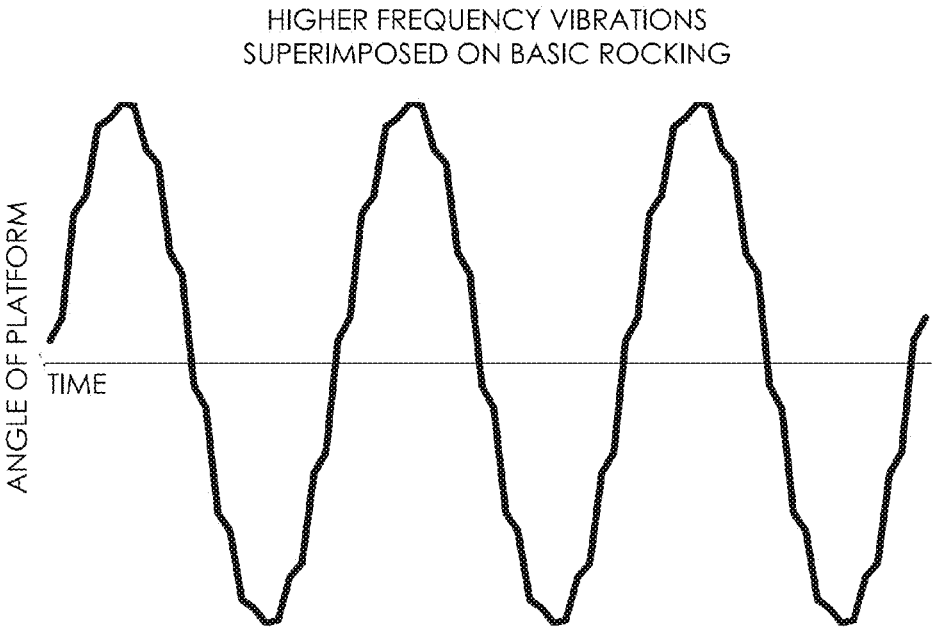
FIG. 12 shows a graph of platform angle over time during rocking with higher frequency vibrations added to a basic rocking motion.

FIG. 12 is a graph showing a higher frequency, lower amplitude oscillation is superimposed upon a basic rocking routine.

DESCRIPTION

The advanced platform rocker described here can tilt the platform as a function of time, including non-periodically The angle of the platform can be accurately controlled, thereby enabling the platform rocker to perform advanced routines as well as use the angular position of the platform to drive other functions. The electronic circuit accurately controls the angular position of the shaft of the motor. A stepper motor is used, whereby the electronic circuit controls its position, to within a fraction of a step or of a degree of rotation. A home sensor is used to determine when the cam is in a known reference position.

The following provides a means to controllably couple the platform to the motor. The motor rotates the cam. The cam is either on the shaft of the motor or on a separate shaft, coupled by some means, such as with a belt or chain. The platform is connected by a linkage to the cam, so as the cam revolves, the platform tilts back and forth. By controlling the angular position of the cam, the tilt of the platform is controlled. Because there is a defined relationship between the angular position of the shaft of the motor and the angular position of the cam, the tilt of the platform can be controlled accurately.

The platform can be electronically controlled to tilt or rock back and forth at a smaller tilt angle, e.g. reversing the rotation of the cam, in order to rotate back and forth for only a portion of a revolution. In standard platform rockers, the motor does not reverse direction, and require mechanical changes to change the range of tilt, e.g. changing the radial distance from the center of the cam to where the linkage pivots. The ability to rock back and forth within a smaller range of tilt angles, and then tilt further as needed, enables this platform rocker to perform additional functions. For example, by tilting further, liquid can be poured out of trays on the platform. To prevent the trays from sliding off the platform, they can be clamped in place. By tilting further in the opposite direction, the liquid can be poured into a different container. Likewise, with a means for piercing on the trays, if the platform is tilted further, the tray can pierce a reservoir holding reagent, and the reagent can flow, under gravity, into the tray on the platform. The lances or other means for piercing can also be affixed to the platform.

While contemporary platform rockers run at a constant speed, the electronic circuit in the advanced platform rocker described here can drive the motor for a period of time, then pause, then continue to repeat this pattern. This platform rocker can also rock at very slow speeds, run quickly in one direction, then slowly in the other, or even run with a high frequency oscillation superimposed on another motion, leading to a vigorous agitation, e.g. for more rapid washing of blots and gels. The routines can be preprogrammed and/or programmed by the user.

This advanced platform rocker incorporates automated fluid handling, eliminating the need for pumps and valves. A reagent is loaded in reagent tubes The bottom of each reagent tube is sealed, such as with foil seals. Seals are pierced to release reagents which are gravity fed into the trays. Lances are located on the trays and the same motor and controller that drive the rocking of the trays can cause the trays to tilt further from horizontal, enabling the lances to pierce the foil seals.

Similarly, this advanced platform rocker incorporates a separate slider which is a support structure that holds the reagent tubes. By maintaining the platform in a level position, driving the slider into position above the platform, and then tilting the platform, the lances are moved into contact with and puncture the seals of the reagent tubes. After which, the platform returns to the horizontal position and the slider returns to its home position, allowing the tray holding platform to rock without interference. This method uses only a single motor or just two motors to control the dispensing of the reagents without the use of a pump or valve and without sets of tubing. The volumes of reagents that are dispensed are simply determined by the amount pre-loaded into the reagent tubes. Tilting the tray holding platforms to a steep angle, the liquid pours out of the trays, into catch tanks and which direct the liquid to containers, such as a catch tank for waste or recovery containers. The liquids are transferred to these waste containers or recovery containers without the use of a pump, valves, or tubing.

A cover for each tray is mounted with slotted holes or other gravity based mechanism so that the entire tray is enclosed to prevent evaporation, yet when the tray is tilted at a relatively large angle in one direction, the drain spout is exposed and when tilted in the other direction beyond the typical rocking angle, the inlet region by the lances is exposed.

This advanced platform rocker can wash blots more aggressively by superimposing a higher frequency vibration onto the rocking motion. Advanced rocking such as moving forward 3 steps of rotation, back 2, forward 3, back 2, can be performed rather than a continuous progression in one direction.

In addition, external devices or sensors can communicate with the electronic circuit, thereby affecting the rocking parameters and/or signaling the advancement to the subsequent step in the rocking routine. For instance, a camera could monitor the blots and image processing software could be used to determine when the washing was completed, so as not to overwash or underwash, ensuring the best contrast.

Another feature would be a Bluetooth or internet connection to signal the user when the program was done or the status of the program at any time.

Programs could be introduced via Bluetooth, SD cards, Ethernet, Wi-Fi or USB memory sticks, or other method, in addition to programming at the instrument itself.

While the preferred embodiment uses a microcontroller in the electronic circuit, a field programmable gate array, logic chips, or other electronic means could control the rocking and other actions of the platform rocker.

In other embodiments, one or more sensors monitor the angular position of the motor shaft, such as with an encoder, the tilt of the platform, or the angle or position of the linkage.

In one embodiment, the electronic circuit also controls a means for transferring heat to or from the trays, such as a thermoelectric device mounted adjacent to the trays.

An external device can communicate with the electronic circuit, using a means such as Bluetooth. For example, an optical sensor, such as a CCD camera would provide signals to the electronic circuit, which then determines when a predetermined amount of contrast in fluorescence is detected in a blot in the tray, thereby signaling that the washing is complete and the rocking proceeds to the next step in the routine. Likewise, sensors monitor the ambient temperature, and the electronic circuit changes the rocking rate or times in response. Analogously, signals from another device, e.g. when it pours liquid into a tray on the platform, indicate to the electronic circuit to alter the rocking or to proceed to the next rocking step or to pause for an image to be taken of samples in the trays.

We claim:

1. A platform rocker for performing time dependent rocking routines, comprising:

a. a platform;
b. a chassis with a plurality of pivots;
c. a motor;
d. an electronic circuit for controlling the angular position of said motor;
e. a means for controllably coupling the rotation of a shaft of said motor to the angular position of said platform;
f. a tray with a plurality of spouts, whereby said tray is removable;
g. said platform to accept said tray;
h. a lance;
i. said lance mechanically coupled to said platform;
j. said lance positioned above said tray.
k. said platform to accept said tray;
l. a reagent tube with a seal on the bottom surface;
m. a support structure to hold said reagent tube;
n. a means to translate said support structure whereby said seal of said reagent tube can be pierced by said lance, whereby liquid flows into said tray;
o. a catch tray positioned below said tray;
p. said catch tray with multiple funnel-shaped regions;
q. at least one recovery container positioned below said catch tray;
r. a catch tank positioned below said catch tray; and
s. a means to translate said catch tray, whereby said liquid can be directed to said at least one recovery container or to said catch tank.

2. The platform rocker of claim 1, wherein said motor is a stepper motor.

3. The platform rocker of claim 1, wherein said tray has a convex bottom.

4. The platform rocker of claim 1, wherein said platform retains and tilts said trays, whereby liquid inside said trays pours out.

* * * * *